US006117094A

United States Patent [19]

Fujii

[11] Patent Number: 6,117,094

[45] Date of Patent: Sep. 12, 2000

[54] MASSAGING APPARATUS AND METHOD OF CONTROLLING THE OPERATION OF THE SAME

[75] Inventor: Yasuo Fujii, Osaka, Japan

[73] Assignee: Family Kabushiki Kaisha, Osaka, Japan

[21] Appl. No.: 09/019,366

[22] Filed: Feb. 5, 1998

[30] Foreign Application Priority Data

Mar. 5, 1997 [JP] Japan ..... 9-050615

[51] Int. Cl.[7] ..... A61H 15/00

[52] U.S. Cl. ..... 601/99; 601/100; 601/102; 601/103; 601/111; 601/116; 601/126

[58] Field of Search ..... 601/46, 49, 63, 601/86, 87, 90, 92–5, 97–103, 115, 116, 118, 108, 110, 111, 126

[56] References Cited

U.S. PATENT DOCUMENTS 4,576,149 3/1986 Otuka et al. .
4,779,615 10/1988 Frazier .
4,984,568 1/1991 Persaud .
5,437,608 8/1995 Cutler .
5,741,218 4/1998 Fujii .
5,792,080 8/1998 Ookawa et al. .

FOREIGN PATENT DOCUMENTS 581796 3/1932 Germany ..... 601/100
2511451 4/1996 Japan .

*Primary Examiner*—Danton D. DeMille
*Attorney, Agent, or Firm*—Oblon, Spivak, McClelland, Maier & Neustadt, P.C.

[57] ABSTRACT

A massaging apparatus includes: a massaging unit movable along the height of a user on the back side of the user; a drive unit for moving the massaging unit along the height of the user; and a control unit for controlling the drive unit so as to position the massaging unit, the control unit including a storage part for storing position data of massaging effective spots as specified position data, and an execution part for reading a data item out of the specified position data and positioning the massaging unit based on the data item thus read.

15 Claims, 10 Drawing Sheets

1*: KENCHUYU 2*: HAIYU 3*: KETSUIN'YU 4*: SHIN'YU 5*: KAKUYU
6*: KAN'YU 7*: HIYU 8*: IYU 9*: SANSHOYU 10*: JIN'YU
11*: DAICHOYU 12*: SHOCHOYU

MASSAGING APPARATUS AND METHOD OF CONTROLLING THE OPERATION OF THE SAME

BACKGROUND OF THE INVENTION

The present invention relates to a massaging apparatus and a method of controlling the operation of such apparatus.

There has hitherto been developed a chair-type massaging apparatus of the type which is capable of automatically varying the height of each massaging position depending on the sitting height of a user (refer to Japanese Patent No. 2511451).

This prior art massaging apparatus operates as follows. A pair of so-called "treating elements" or acting parts for performing kneading, rubbing or other massaging operations are initially raised up to their upper limit position before starting any massaging operation, and then lowered until they contact the shoulders of the user. Upon contact, a pressure sensor embedded in one of the treating elements detects the height of the contact. From a detection signal indicative of the height of the contact generated by the pressure sensor the apparatus determines the height of the contact as a reference point for a series of massaging operations that follows, and then performs such massaging operations at positions above and below the reference point (shoulder position) in sequence as programmed. The upward and downward movable range of the acting parts is divided with a plurality of points, and the pair of acting parts are moved to a required one of these points to perform a massaging operation.

Actual use of the prior art massaging apparatus by numerous individuals having different statures revealed that the apparatus could not necessarily ensure constant, sufficient and satisfactory remedial effects.

This is because this prior art massaging apparatus massages indefinite positions of the user. To enhance remedial effects of massage, accurate and proper stimulation of massaging effective spots which are termed "Meridian Points" in the oriental medicine is effective. Since differences in the position of each effective spot exist between individuals, indefinite numerical control is incapable of accurately and properly stimulating any massaging effective spot.

SUMMARY OF THE INVENTION

Thus, it is an object of the present invention to provide a massaging apparatus which is capable of accurately and properly stimulating massaging effective spots of any user thereby providing constant, sufficient and satisfactory massaging treatment effects, and a method of controlling the operation of such apparatus.

According one aspect of the present invention, there is provided a massaging apparatus comprising: a massaging unit movable along the height of a user on the back side of the user; a drive unit for moving the massaging unit along the height of the user; and a control unit for controlling the drive unit so as to position the massaging unit, the control unit including a storage part for storing position data of massaging effective spots of the user as specified position data, and execution part for reading a data item out of the specified position data and positioning the massaging unit based on the data item thus read out.

Preferably, the storage part prestores as the specified position data mean position data of each of the massaging effective spots for a plurality of stature ranges, while the execution part, when the user selects one of the stature ranges which covers the user's stature, reads a data item corresponding to the stature range thus selected and executes the positioning of the massaging unit based on the data item thus read out.

Each specified position is the position of each effective spot and is represented as a distance from a shoulder. position serving as a reference position. The reference position is not limited to the shoulder position and may be any position on the back side of the user, for example, a waist position. However, the specified position data for determining each specified position is preferably mean position data obtained by measuring the statures of numerous individuals and the distance between predetermined portions of each individual (for example, between the shoulder position and the waist position) and totalizing and averaging such distances for each predetermined stature range. In other words the specified position data is obtained based on statistics.

When the user selects the stature range covering his or her stature and inputs it to the control unit during starting up operations, the control unit selects data items from the stored specified position data corresponding to the selected stature range and reads the data items thus selected. Based on the specified position data items thus read out the control unit controls the amount of a move of the massaging unit through the drive unit.

The present invention is based on the knowledge that the position of each massaging effective spot significantly varies between individuals depending on the differences in sitting height, age, sex, body form and the like and that if such factors are taken into consideration in combination, use of indefinitely standardized numeric data makes it impossible to realize positioning control adaptable for numerous individuals. Thus, in the present invention data has been actually collected from numerous individuals who are different in stature, age, sex, body form and the like.

The present invention particularly makes great account of the principle that massaging effective spots should be massaged to effectively relieve the stiffness in a human body and takes notice of the fact that such effective spots are aligned along the backbone on opposite sides thereof. Thus, the specified position data to be stored in the control unit is data of respective positions of such effective spots aligned along the backbone.

Accordingly, the data to be collected from a number of individuals comprises position data of predetermined effective spots. The position of each effective spot may be measured based on medical materials but is preferably determined in view of indication and touch based on empirical knowledge of professionals such as practitioners in acupuncture and moxibustion, finger-pressure therapists and massage therapists and, as the case may be, in view of feelings of each subject of data collection. Since such professionals are very familiar with objectives that can be attained by massage such as recovery from ordinary muscular fatigue, enhancement of the internal organs, improvements in bowel action and relief from lumbago and with a slight difference in the position of each effective spot reflecting combination of differences in stature, sex, age, body form, case history and the like, data thus obtained provides for highly effective massage.

The specified position data may include position data of a reference point which is established, for example, at a predetermined position adjacent the shoulders. In this case the rest of the specified position data is position data of each effective spot represented by the distance from the reference point.

The control unit is preferably so constructed to have a function of causing the massaging unit to reciprocate along the height of the user within a predetermined range from any specified position at which the massaging unit is positioned.

If the control unit is provided with such a function as to allow the massaging unit to inch along the height of the user from any specified position after the massaging unit has been caused to move to that specified position on the basis of a data item of the specified position data, the apparatus can accommodate the case where there is a slight difference between the mean position and real position of a massaging effective spot. The massaging apparatus with the above function can also accommodate the following cases where the user changes his or her posture in the apparatus, where a stiff portion is slightly shifted from the mean position of the corresponding effective spot, where the user has an injured portion at a position coinciding with the specified position of an effective spot, where the user wishes to be massaged as desired, and like cases.

Also preferably, the control unit has a position indicating portion for indicating the current position of the massaging unit.

By providing such a position indicating portion for informing the user of the current position of the massaging unit, the user becomes capable of knowing the progress of a massaging program. The provision of the position indicating portion also aids the user in conveniently maintaining his or her health by preponderantly massaging particularly stiff portions. The position indicating portion indicates the current position of the massaging unit using, for example, voice, sound (buzzing) or light.

The control unit may have a data inputting part which allows position data of massaging effective spots of a user to be entered and stored in the storage part. In this case it is possible to input personal position data of user's own massaging effective spots instead of storing general position data of effective spots for wide use. With this feature the apparatus becomes capable of more accurately and properly massaging the user's own effective spots.

Further, the control unit may be provided with a course selecting section for selecting a data item of the specified position data to be read out. Specifically, the course selecting section can select any one of fatigue relieving course, digestive system enhancing course, bowel action enhancing course, liver trouble remedying course, lumbago remedying course, neuralgia mitigating course and a like course.

The massaging apparatus of the present invention may further comprise a seat portion and a backrest portion, wherein the massaging unit is disposed in the backrest portion and has an acting element for performing a massaging operation, and the control unit is capable of positioning the massaging unit so as to locate the acting element at a position coinciding with any one of the massaging effective spots.

The massaging unit may include two driving devices for causing the acting element to swing in two directions along the height and the breadth of the user, each of the driving devices comprising an expansible and contractible air cell.

By controlling the pressure, amount, flow rate and the like of air to be supplied to and discharged from the air cell, various massaging operations can be realized.

According to another aspect of the present invention, there is provided a method of controlling the operation of the massaging apparatus comprising: storing position data of a plurality of massaging effective spots as specified position data; reading a data item out of the specified position data; and positioning the massaging unit based on the data thus read out.

In this method it is possible to prestore as the specified position data mean position data of each of the massaging effective spots for each of a plurality of stature ranges. When the user selects one of the stature ranges that covers his or her stature, the apparatus reads a data item out of the specified position data which corresponds to the stature ranges thus selected and executes a required operation based on the data item thus read out.

In this case the mean position data is obtained by collecting position data of a plurality of massaging effective spots aligned along the backbone from a multiplicity of individuals having different statures, sorting the position data thus collected for each of predetermined stature ranges and averaging each group of the position data thus sorted. The resulting mean position data is prestored as the specified position data.

Upon entry of a stature during the starting up operation, a stature range covering this stature is selected and a plurality of specified position data items (position data of massaging effective spots) corresponding to the stature range thus selected are partially or wholly read out. Then, the drive unit is caused to operate with a predetermined time period of break at each specified position based on each specified position data item thus read out.

Thus, the user enjoys an effective automated massage onto his or her body either partially or wholly.

It is possible to appropriately change the time interval of a move of the acting element (massaging unit) between one specified position and another, the order of massaging positions and the combination of specified position data items depending on the purpose of massage and the like.

Alternatively, it is possible to construct the control unit so as to allow free entry and storage of personal position data of user's own effective spots as the specified position data. Such user's personal data ensures more accurate and proper massage.

Advantageously, the method of the present invention may comprises the step of causing the massaging unit to perform massaging while reciprocating along the height of the user within a predetermined range from any specified position at which the massaging unit is positioned.

The foregoing and other objects, features and attendant advantages of the present invention will be readily appreciated as the same becomes better understood by reference to the following detailed description when considered in connection with the accompanying drawings.

DETAILED DESCRIPTION OF THE PREFERRED EMBODIMENTS

The present invention will now be described in detail with reference to the drawings.

Figure 1:
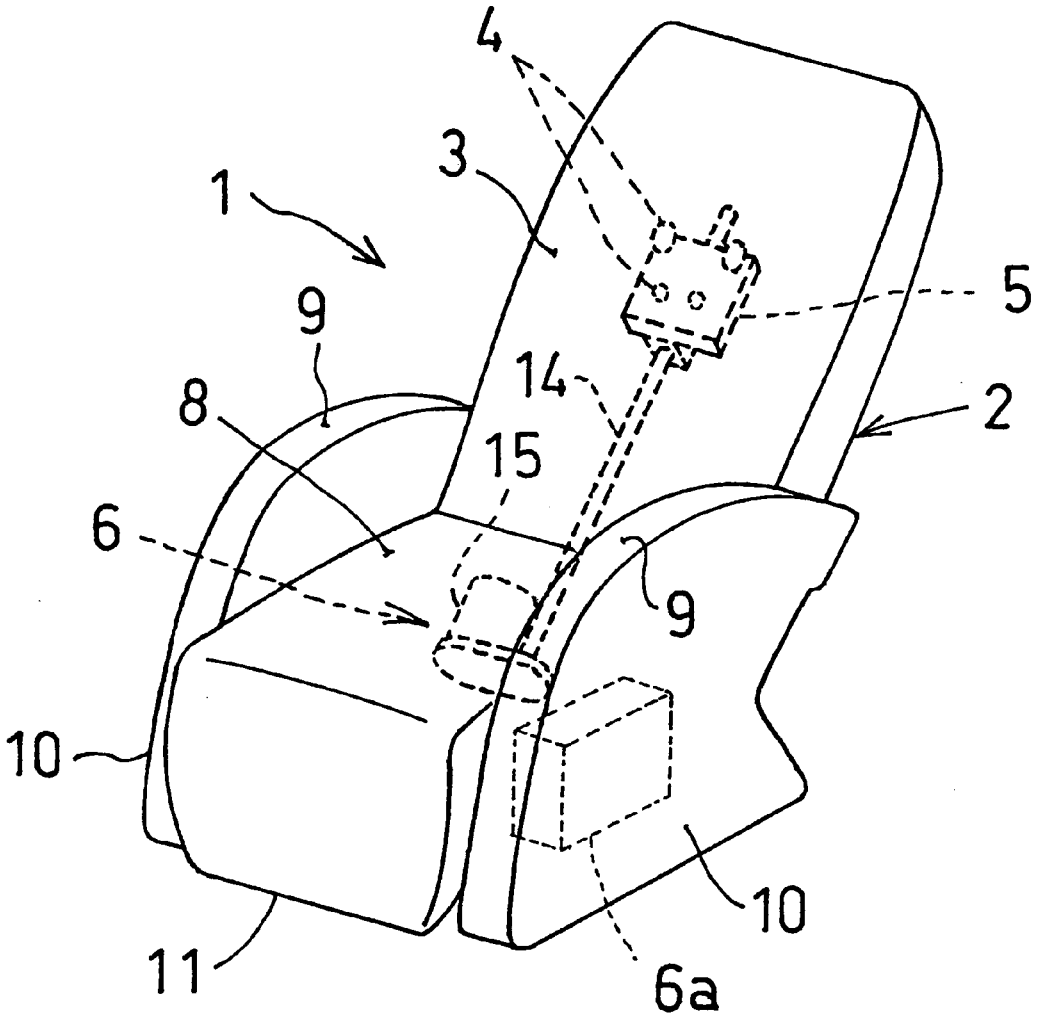
FIG. 1 is a schematic perspective view showing a chair-type massaging apparatus according to the present invention.

Referring to FIG. 1, chair-type massaging apparatus 1 according to the present invention basically includes a chair body 2 having a backrest portion 3 provided with upper and lower acting elements 4, a massaging unit 5 for causing the upper and lower pairs of acting elements 4 to perform massaging, and a drive unit 6 for causing the massaging unit 5 to travel upwardly and downwardly along the longitudinal axis of the backrest portion 3 to a desired position.

Figure 2:
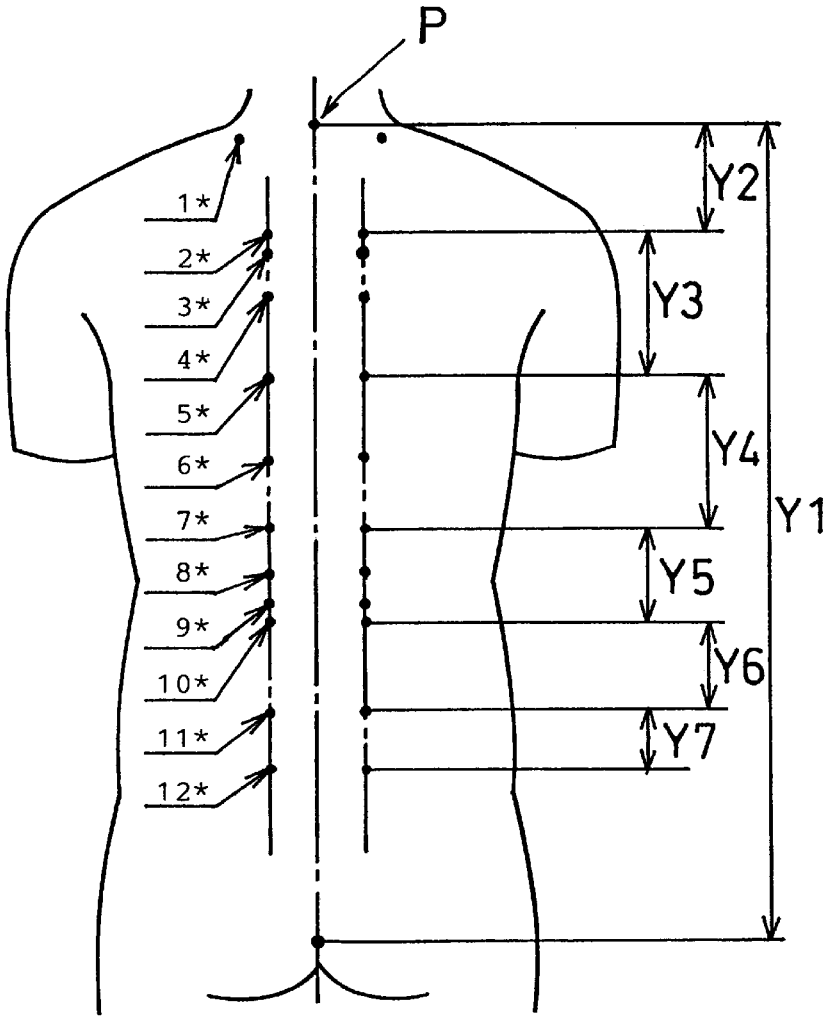
FIG. 2 is a fragmentary rear elevational view of a human body in which the positions of massaging effective spots to be massaged according to the present invention are illustrated.

The drive unit 6 is provided with a control unit 6*a* comprising control circuitry for controlling the operation of the drive unit 6. More specifically, the control to be achieved by the control unit is such as to cause the massaging unit 5 to travel to a position where the upper or lower pair of acting elements 4 thereof are positioned coinciding with specified positions on the back side of a user, for example, positions of each pair of massaging effective spots as shown in FIG. 2. Massaging effective spots as used herein are, for example, "Meridian Points" termed in the oriental medicine, and those shown in FIG. 2 are aligned in pairs along the backbone of a human with each pair of massaging effective spots located symmetrically about the backbone.

The present invention is not particularly limited to the massaging apparatus 1 shown.

The chair body 2 has a seat portion 8 supported on opposite sides thereof by a pair of leg portions 10 each formed integrally with an armrest portion 9, and a footrest 11 situated in a front part of the seat portion 8.

The angular position of each of the footrest 11 and the backrest portion 3 relative to the seat portion 8 can be varied by an appropriate electric or fluid pressure drive mechanism (not shown) for the chair body 2 to recline. As the angular positions of these components are varied, the seat portion 8 is also movable forward and backward and upward and downward to a certain extent.

The drive unit 6 comprises a feed screw 14 extending longitudinally of the backrest portion 3 and threadingly engaging the massaging unit 5, and a power source part 15 including a motor and the like for forwardly and reversely rotating the feed screw 14 to move the massaging drive unit 5 toward the neck or the waist of the user.

Alternatively, the drive unit 6 may comprise a wrapping connector driving mechanism, a rack and pinion mechanism or any other means for linearly moving the massaging unit 5 using, for example, a fluid pressure cylinder.

Figure 3:
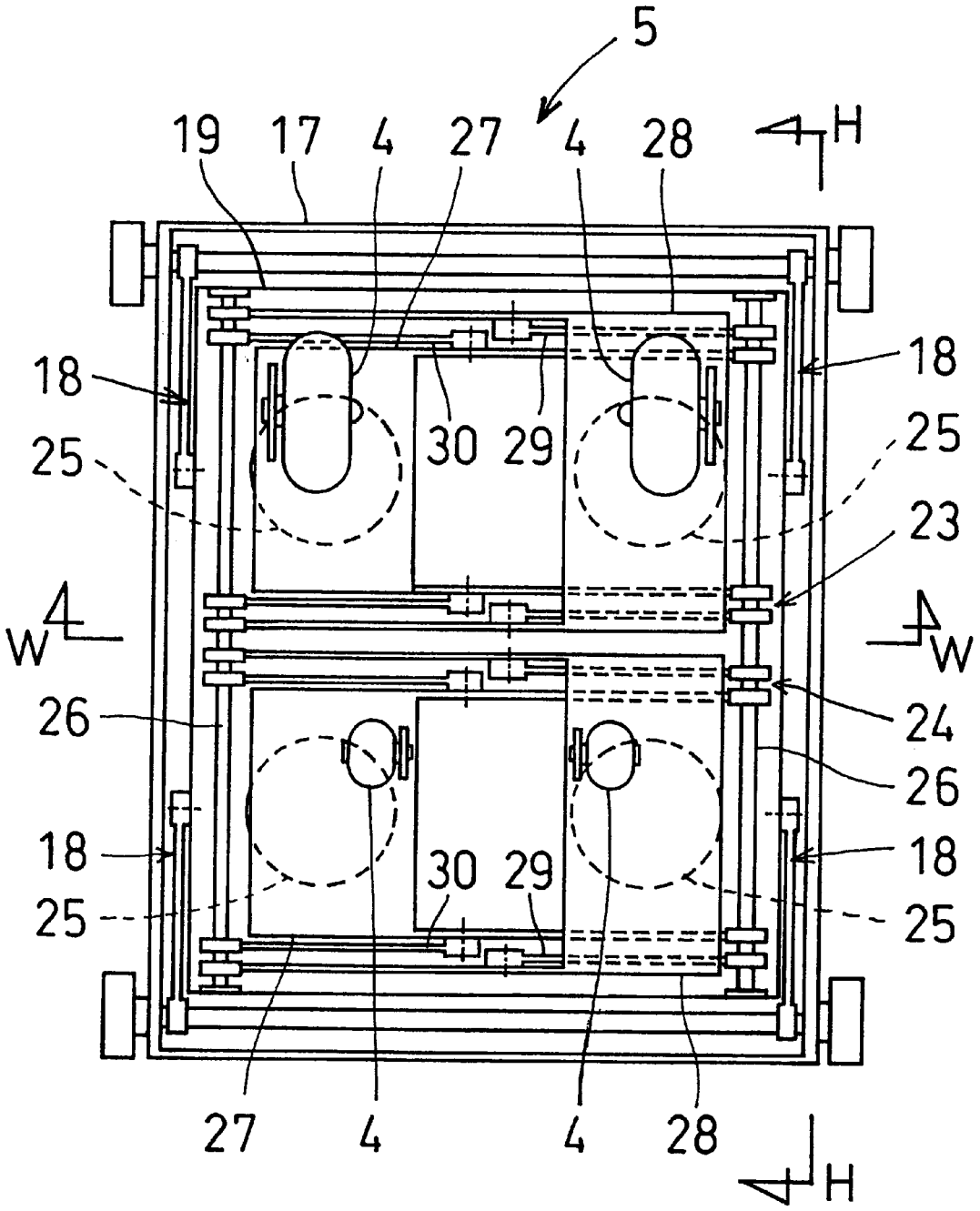
FIG. 3 is a front elevational view of a massaging unit of the massaging apparatus.
Figure 4:
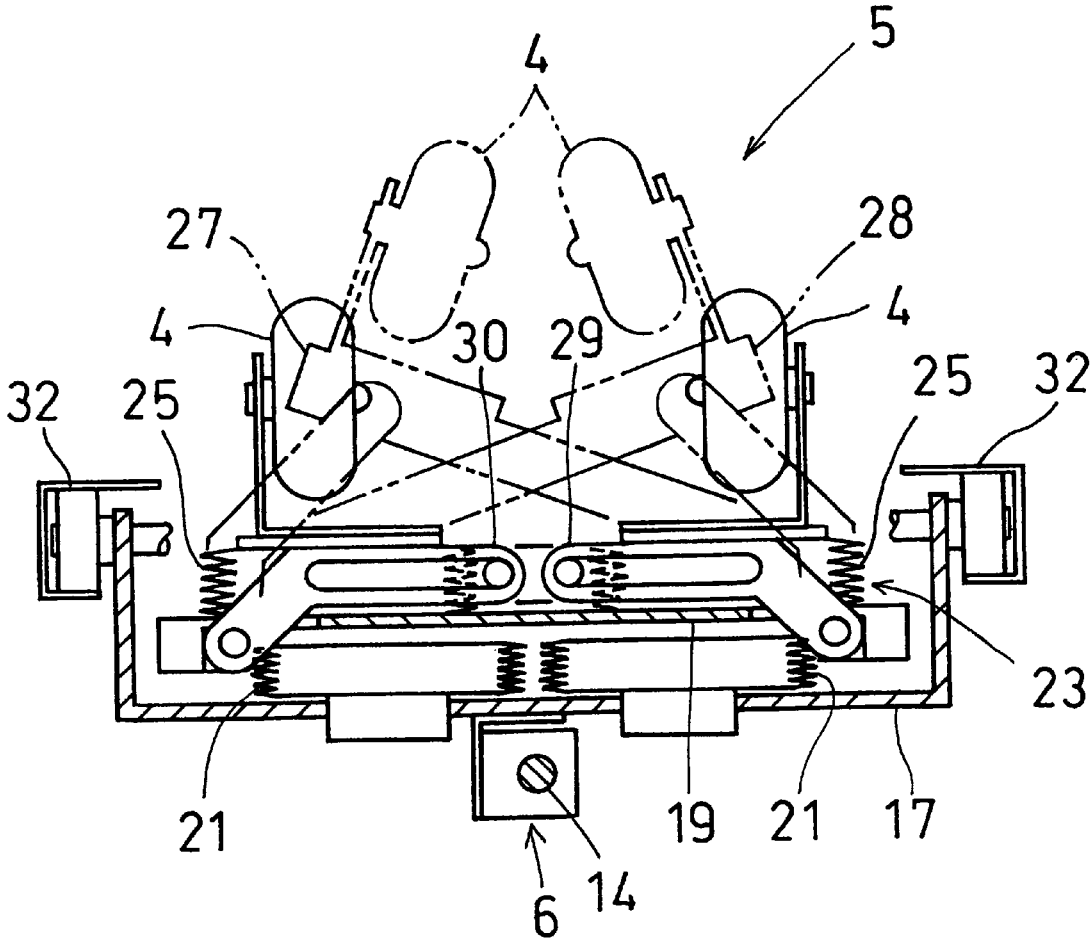
FIG. 4 is an enlarged sectional view taken on line W—W of FIG. 3.
Figure 5:
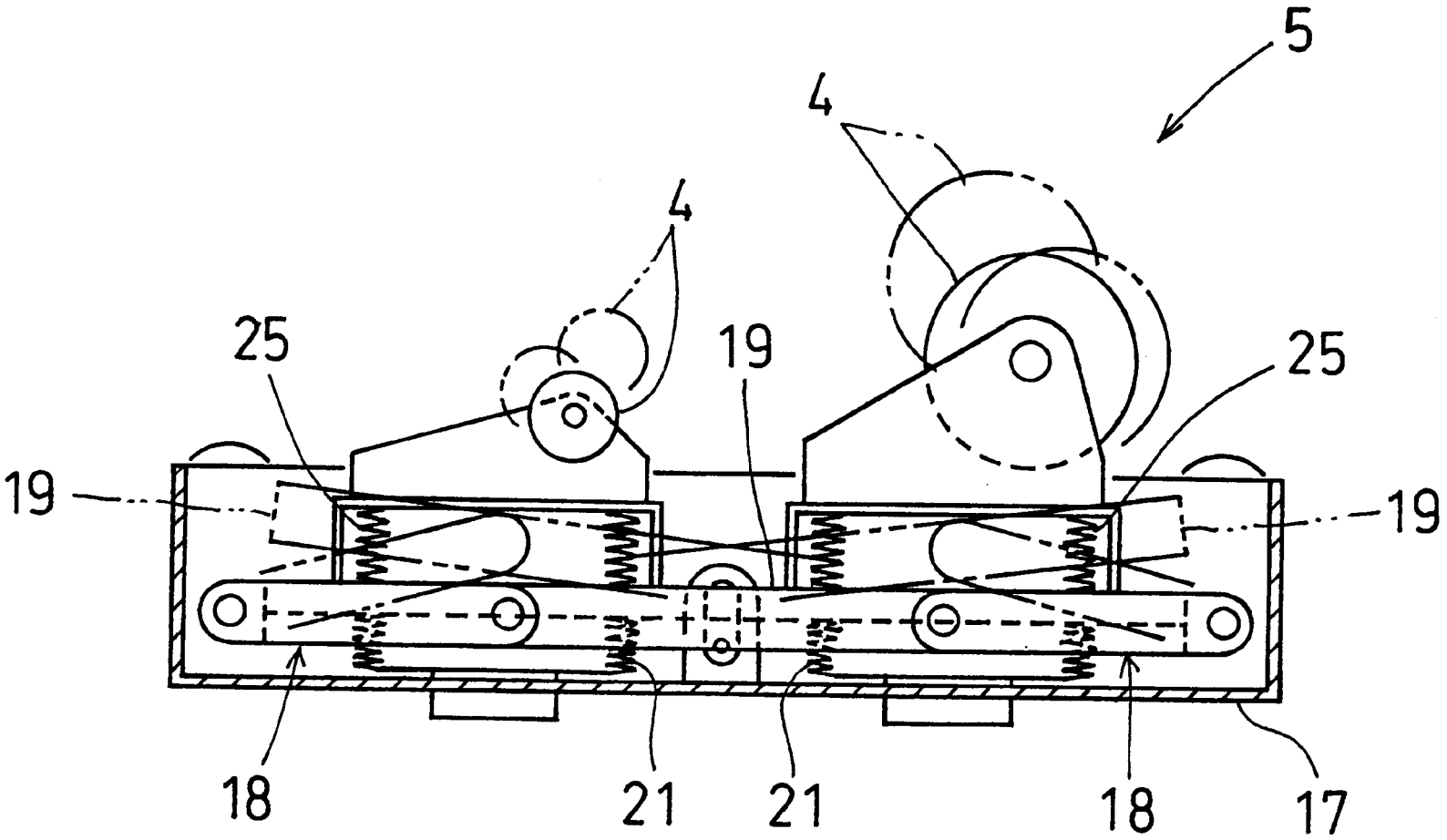
FIG. 5 is an enlarged sectional view taken on line H—H of FIG. 3.

As shown in FIGS. 3 to 5, the massaging unit 5 includes a base frame 17 to be moved directly by the drive unit 6, swing plates 19 each mounted on the base frame 17 through a pair of opposite lateral link mechanisms 18 so as to be swingable forwardly and rearwardly of the backrest portion 3 about its upper or lower edge, swing plate drives 21 interposed between the base frame 17 and the swing plates 19, upper and lower link mechanisms 23,24 associated with the respective swing plates 19, and upper and lower pairs of link drives 25 respectively associated with upper and lower link mechanisms 23,24.

The upper and lower pairs of acting elements 4 are attached to these link mechanisms 23,24, respectively, and each acting element 4 is formed into a roller which is rotatable about a transversely extending shaft. The upper pair of acting elements 4 attached to the upper link mechanism 23 are greater in diameter than the lower pair of acting elements 4 attached to the lower link mechanism 24 and hence project more largely from the backrest portion 3 than the latter. Further, the spacing between the upper pair of acting elements 4 is greater than that between the lower pair of acting elements 4.

Referring to FIGS. 3 and 4, the upper link mechanism 23 comprises a pair of right and left longitudinal shafts 26, acting element support frames 27, 28 respectively supported on the longitudinal shafts 26 for pivotal movements crossing each other, and links 29,30 for restricting the ranges of such pivotal movements. The lower link mechanism 24 is of the same construction as the upper link mechanism 23.

The aforementioned link drives 25 are interposed between the corresponding acting element support frames 27,28 and the corresponding swing plates 19. In this embodiment each link drive 25 comprises an air cell of a bellows or balloon construction. Thus, when pressurized air is supplied to each link drive 25, the link drive 25 expands along the axis thereof thereby causing the corresponding acting element 4 to swing about the corresponding longitudinal shaft 26 in a manner to project obliquely forward of the backrest portion 3. On the other hand, when the pressurized air is discharged or sucked frog each link drive 25, the link drive 25 contracts along the axis thereof thereby returning the corresponding acting element 4 into its original position. With this construction, by synchronously controlling supply and discharge of pressurized air to and from the opposite link drives 25 the corresponding right and left acting elements 4 move toward and away from each other repeatedly to perform a kneading operation.

As best shown in FIGS. 4 and 5, the swing plate drives 21 interposed between the base frame 17 and the swing plates 19 include upper and lower pairs of swing plate drives disposed substantially in coincidence with the upper and lower pairs of link drives 25. The upper pair of swing plate drives 21 corresponding to the link drives 25 of the upper link mechanism 23 and the lower pair of swing plate drives 21 corresponding to the link drives 25 of the lower link mechanism 24 are adapted to operate synchronously or alternately with each other by controlling supply and discharge of pressurized air thereto and therefrom.

Thus, if supply and discharge of pressurized air is carried out with respect to the upper and lower pairs of swing plate drives 21 alternately, the upper and lower pairs of acting elements 4 alternately project and retract by alternate swinging movements of the upper and lower pairs of swing plates 19, thus realizing a pressing operation like a finger pressure treatment or a tapping operation.

Alternatively, if supply and discharge of pressurized air is carried out with respect to both the upper and lower pairs of swing plate drives 21 simultaneously, all the acting elements 4 project and retract synchronously thereby providing a pressing or tapping operation of a somewhat different pattern than the former.

In the massaging apparatus 1 thus constructed the control unit 6*a* for operating the drive unit 6 is capable of positioning the upper or lower pair of acting elements 4 into coincidence with any specified positions on the back side of the user leaning against the backrest portion 3. For this purpose the control unit 6*a* prestores therein specified position data (dimensional data to be used by the apparatus) for allowing the drive unit 6 to move the massaging unit 5 to a position where the upper or lower pair of acting elements 4 coincide with desired specified positions on the back side of the user.

Where specified positions are positions of massaging effective spots aligned in pairs along the backbone of a human as shown in FIG. 2, specified position data is obtained in the following manner.

A large number of individuals having different statures are subjected to measurement of stature, sitting height (Y1 from the bottom to measuring reference point P) and positions (levels) of massaging effective spot pairs (distances Y2,Y3, Y4 . . . measured directly or indirectly from the reference point P). For example, the distance Y2 corresponds to the position of the effective spot pair named "Haiyu", the distance Y3 to the position of the effective spot pair named "Kakuyu", and the distance Y4 to the position of the effective spot pair named "Hiyu".

In this embodiment the positions of those effective spot pairs located lower than "Haiyu" (Y2) are each represented by the distance measured from an upper adjacent one. However, all the effective spot pairs may each be represented by the distance measured directly from the reference point P.

The distances Y2 to Y7 in FIG. 2 correspond to the positions of exemplary effective spot pairs only, and the positions of other effective spot pairs shown (Kenchuyu, Ketsuin'yu, Shin'yu and the like) and those of a number of not shown effective spots existing on the back side of a human may be measured as required.

Next, the data of the position of each effective spot pair thus collected is sorted and averaged for each predetermined stature range to obtain mean position data. The mean position data thus obtained is used as the specified position data.

In this embodiment the whole stature range is divided into stature ranges A to F in increments of about 3 to about 5 cm and distances Y1 to Y7 are obtained for each of the stature ranges A to F as shown in Table 1. The data in Table 1 has been obtained from 100 or more individuals for each stature range.

TABLE 1

| | (unit: cm) | | |
|---|---|---|---|
| | Maximum | Minimum | Average |
| | Stature Range A (150.0–155.7) | | |
| Y1 | 55.0 | 51.0 | 53.4 |
| Y2 | 8.0 | 5.0 | 6.4 |
| Y3 | 11.0 | 7.0 | 9.3 |
| Y4 | 10.0 | 7.0 | 9.1 |
| Y5 | 8.0 | 5.0 | 7.3 |
| Y6 | 5.0 | 3.0 | 3.9 |
| Y7 | 6.0 | 5.0 | 5.6 |
| | Stature Range B (157.0–160.0) | | |
| Y1 | 58.0 | 49.0 | 54.4 |
| Y2 | 7.0 | 6.0 | 6.5 |
| Y3 | 11.0 | 8.0 | 9.5 |
| Y4 | 12.0 | 8.0 | 9.6 |
| Y5 | 8.0 | 6.0 | 7.1 |
| Y6 | 6.0 | 3.0 | 4.2 |
| Y7 | 8.0 | 4.0 | 5.9 |

TABLE 1-continued

| | (unit: cm) | | |
|---|---|---|---|
| | Maximum | Minimum | Average |
| | Stature Range C (162.0–165.4) | | |
| Y1 | 67.0 | 50.0 | 56.2 |
| Y2 | 10.0 | 5.0 | 7.2 |
| Y3 | 12.0 | 7.0 | 9.6 |
| Y4 | 12.0 | 8.0 | 10.1 |
| Y5 | 10.0 | 6.0 | 8.0 |
| Y6 | 10.0 | 3.0 | 4.5 |
| Y7 | 7.0 | 2.0 | 5.3 |
| | Stature Range D (166.0–170.6) | | |
| Y1 | 65.0 | 51.0 | 58.8 |
| Y2 | 8.0 | 6.0 | 7.4. |
| Y3 | 13.0 | 9.0 | 10.5 |
| Y4 | 12.0 | 9.0 | 10.1 |
| Y5 | 11.0 | 7.0 | 8.2 |
| Y6 | 5.0 | 4.0 | 4.5 |
| Y7 | 9.0 | 3.0 | 6.4 |
| | Stature Range E (171.0–175.0) | | |
| Y1 | 63.0 | 51.0 | 59.1 |
| Y2 | 9.0 | 5.0 | 7.4 |
| Y3 | 14.0 | 8.0 | 10.2 |
| Y4 | 12.0 | 9.0 | 10.7 |
| Y5 | 11.0 | 5.0 | 8.7 |
| Y6 | 8.0 | 3.0 | 4.6 |
| Y7 | 11.0 | 2.0 | 6.5 |
| | Stature Range F (179.0–183.0) | | |
| Y1 | 65.0 | 58.0 | 61.9 |
| Y2 | 8.0 | 6.0 | 7.4 |
| Y3 | 12.0 | 9.0 | 10.8 |
| Y4 | 12.0 | 10.0 | 11.1 |
| Y5 | 11.0 | 8.0 | 9.4 |
| Y6 | 6.0 | 4.0 | 4.8 |
| Y7 | 8.0 | 5.0 | 6.3 |

When a user sitting in the chair body 2 inputs his or her stature during the starting operation, the control unit 6*a* storing such specified position data selects one of the stature ranges A to F which covers the stature thus input and then reads specified position values Y1 to Y7 corresponding to the stature range thus selected out of the specified position data. Based on the specified position values thus read, the control unit 6*a* directs the drive unit 6 to perform predetermined operations sequentially. In other words, the control unit 6*a* has an execution part for reading the specified position data and positioning the massaging unit 5. The storage part and execution part of the control unit 5 comprises a microcomputer.

For example, if the input stature is within the stature range A, the control unit selects the stature range A and judges that the reference point P is located above the seating surface of the seat portion 8 as spaced by distance Y1 (53.4 cm) therefrom. Subsequently, the control unit 6*a* calculates the distance and direction from the current position of the upper or lower pair of acting elements 4 to a position where the upper or lower pair of acting elements 4 coincide with the position of a predetermined effective spot pair (for example, "Haiyu") taking the reference point P and the distance Y2 (6.4 cm) into consideration and directs the drive unit 6 to move the massaging unit 5 to the intended position. In this embodiment the control unit 6*a* controls the drive unit 4 so that the upper pair of acting element is positioned coinciding with any of the effective spot pairs.

To detect the current position and to measure the distance the upper or lower pair of acting elements 4 have moved, a detector for detecting the number of revolutions such as a rotary encoder or a rotary-type potentiometer (not shown) may be provided to detect the number of revolutions of the feed screw 14 of the drive unit 6 or that of the rotary portion of the power source part 15 for calculation of the distance of a move of the massaging unit 5 from the number of revolutions thus detected.

Instead, the distance of a move of the massaging unit 5 may be directly measured using distance measuring means such as a linear-type potentiometer (not shown) disposed along rail member 32 adapted to guide the massaging unit 5 or along the feed screw 14 in combination with a detector (not shown) provided on the massaging unit side.

After the upper or lower pair of acting elements 4 are thus moved to the intended position, the massaging unit 5 drives the acting elements 4 for a predetermined time to massage the intended effective spot pair (for example, Haiyu).

Preferably, the control unit 6*a* is so constructed as to control the drive unit 6 so that the massaging unit 5 can automatically reciprocates upwardly and downwardly after the upper or lower pair of acting elements 4 reach the intended specified position. In other words, the acting elements 4 perform massaging while reciprocating within a limited range. Such a limited range is suitably about ±20 mm from a specified position.

With such construction, the upper or lower pair of acting elements 4 can assuredly stimulate any effective spot pair even if there is a slight difference between the mean position and the real position of the effective spot pair. Further, this construction can flexibly accommodate such cases where the user changes his or her posture in the apparatus after the reference point P is established, where a stiff portion is slightly shifted from the mean position of the intended effective spot pair, where the user has an injured portion at a position corresponding to any one of the specified position data items, where the user wishes to be massaged according to his or her desire, and like cases.

The reciprocating movement of the acting elements 4 within the limited range may be achieved by a manual operation of a switch.

In turn, the control unit 6*a* directs the drive unit 6 to move the massaging unit 5 the distance Y3 (9.3 cm) in a required direction so that the upper or lower pair of acting elements 4 move from their current position to the position of a next effective spot pair (for example, "Kakuyu"). Then, the massaging unit 5 drives the acting elements 4 to massage the next effective spot (for example, "Kakuyu") for a predetermined time.

As apparent from the foregoing description, the time interval from the point of time at which the control unit 6*a* directs the drive unit 6 to operate based on one item of the specified position data to the point of time at which the control unit next directs the drive unit 6 to operate based on a next item of the specified position data is determined taking the required operating time period of the massaging unit 5 into consideration.

By repeating such operations the apparatus can effectively massage the user wholly or partially in an automated manner.

The following is one example of a specific massaging program to be executed by the massaging apparatus of the present invention.

Figure 6:
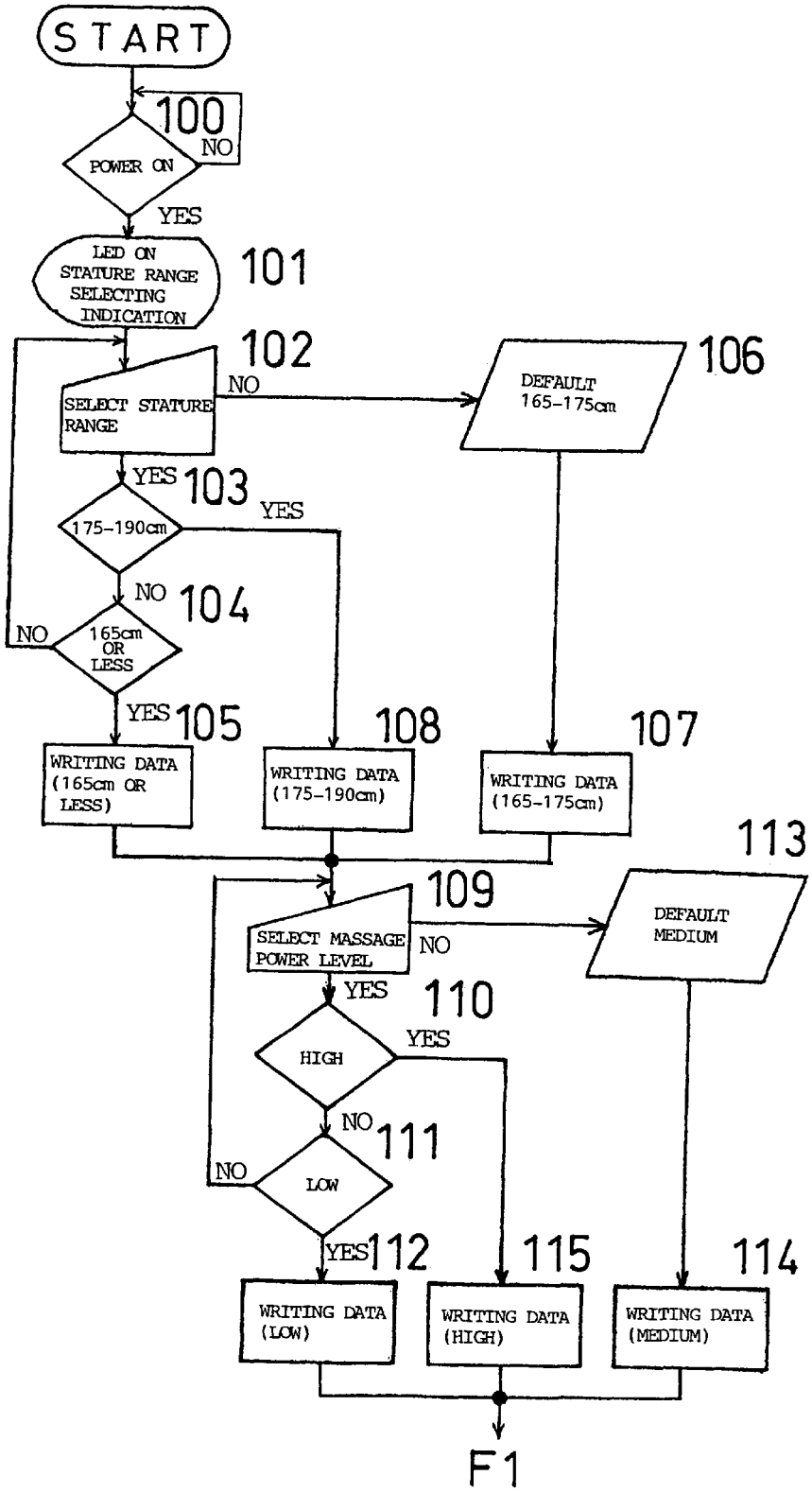
FIG. 6 is a flow chart of an initial part of a massaging procedure of the massaging apparatus.
Figure 7:
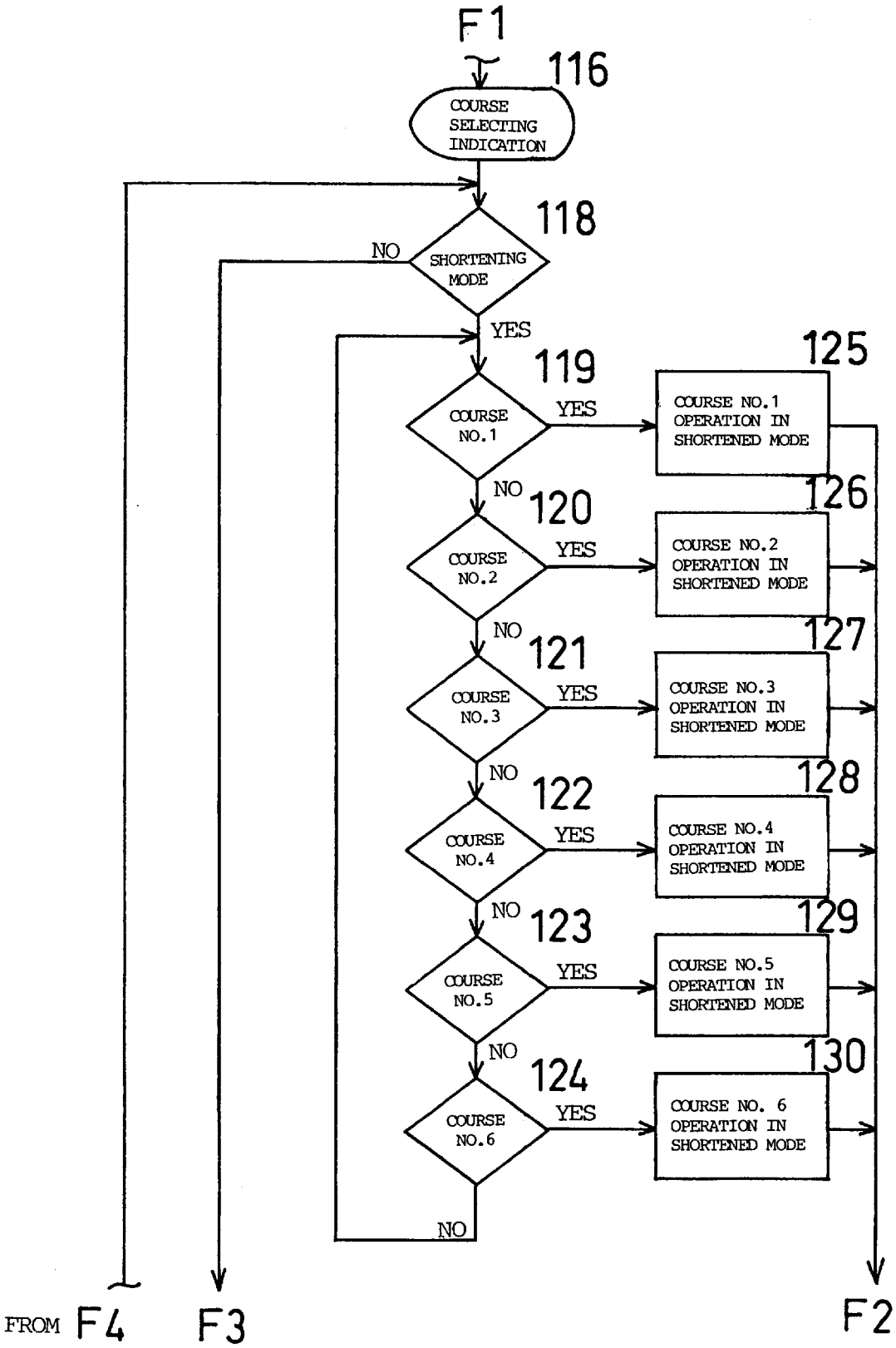
FIG. 7 is also a flow chart of an intermediate part of the massaging procedure that follows FIG. 6.
Figure 8:
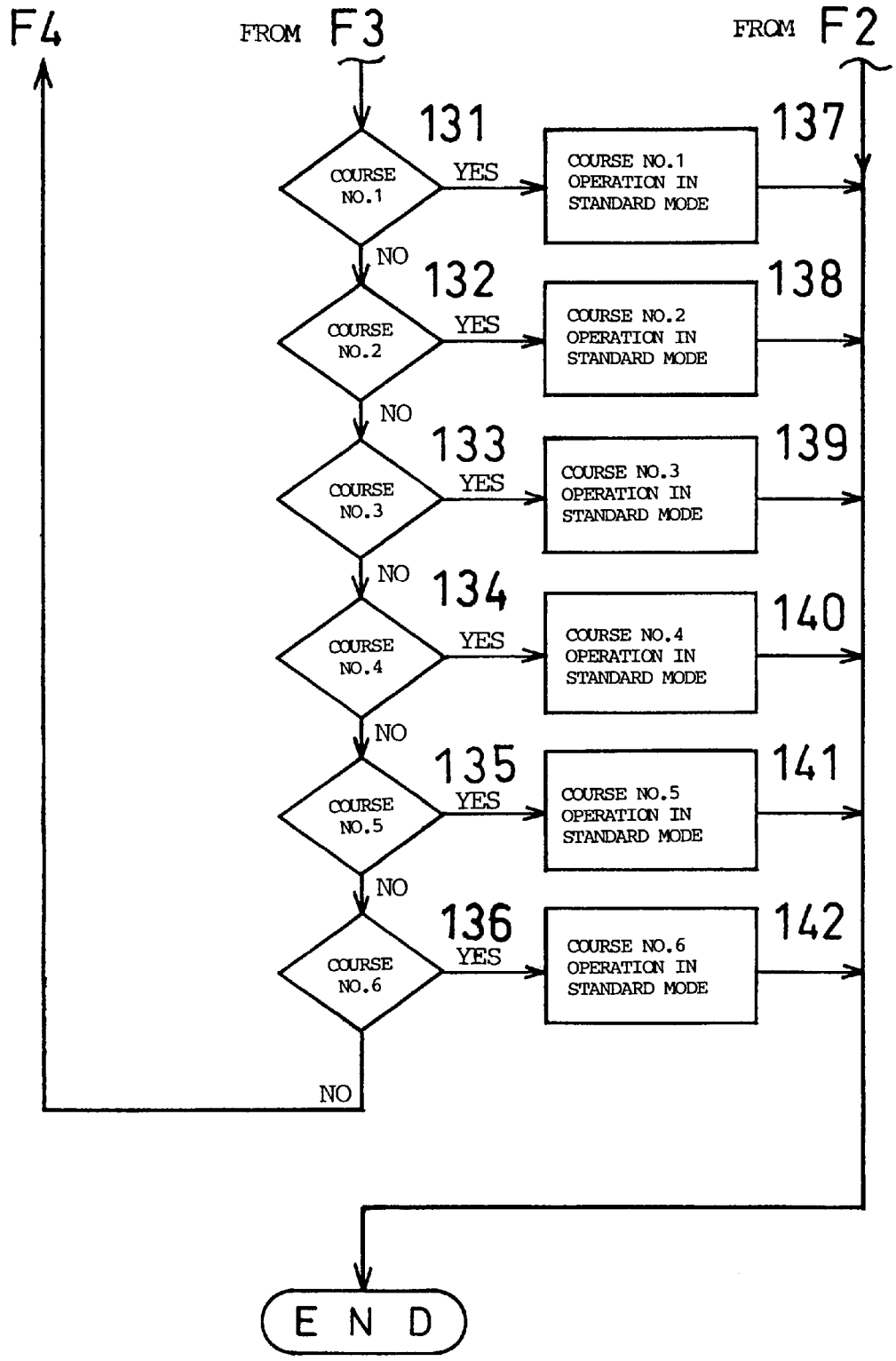
FIG. 8 is also a flow chart of an final part of the massaging procedure that follows FIG. 7.

FIGS. 6 to 8 are a flow chart of the operation procedure from the starting of the massaging apparatus to the end of a massaging program selected.

Figure 9:
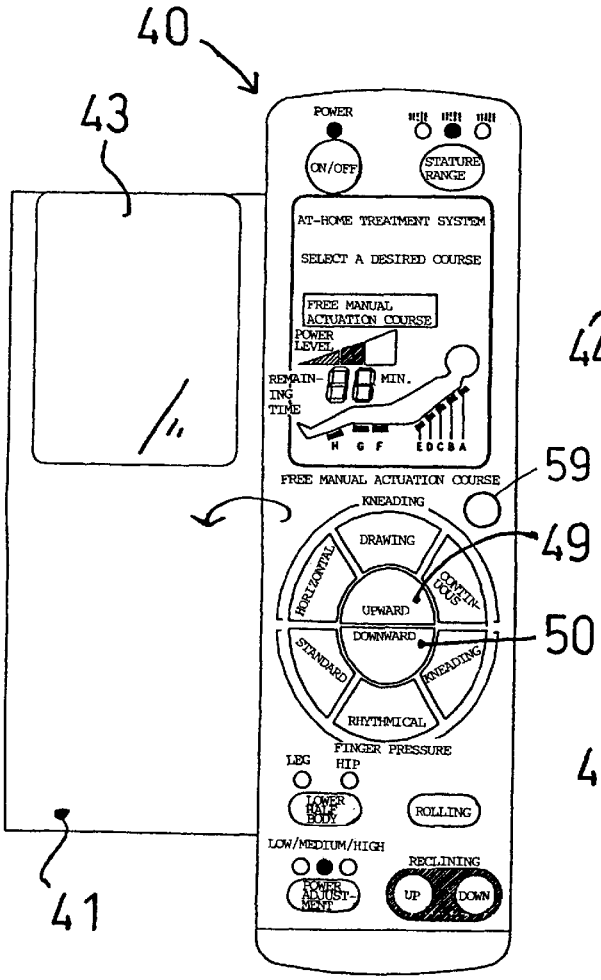
FIG. 9 is a view illustrating a controller for operating the massaging apparatus, in which FIG. 9(*a*) shows the controller with its cover open, and FIG. 9(*b*) shows the controller with its cover closed.
Figure 9:
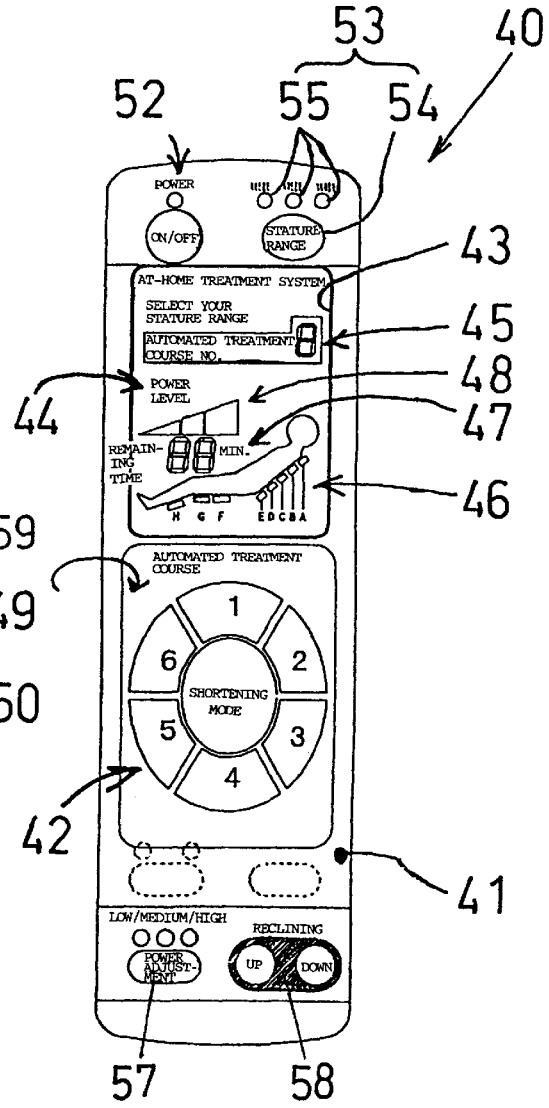

FIG. 9 illustrates a controller 40 to be manipulated by a user for starting various operations of the massaging apparatus. This controller 40 forms part of the control unit 6*a*.

The controller 40 has an openable cover 41 on the front side thereof. When the cover 41 is open as shown in FIG. 9(*a*), the controller 40 allows the user to select a desired one of various manual operations, while on the other hand when the cover 41 is closed as shown in FIG. 9(*b*), the controller 40 offers a plurality of automated massaging treatment courses for selection. Reference will be made mainly to the function of the controller 40 with the cover 41 in the closed state.

On the front side of the cover 41 are provided a course selecting section 42 in the lower half portion thereof and a transparent cover section 43 in the upper half portion thereof. A display surface 44 is seen through the transparent cover section 43. The course selecting section 42 has six numbered keys Nos. 1 to 6 arranged annularly and a shortening mode key disposed in the center of the annularly arranged numbered keys. The six numbered keys correspond to six standard automated massaging treatment courses for selection and, hence, when the user selectively depresses any one of these keys then the user enjoys the corresponding standard massaging treatment. When the user wishes a shortened massaging treatment, the user should depress the shortening mode key and any desired one of the numbered keys in combination to select a desired shortened automated massaging treatment course. Thus, the massaging apparatus offers twelve massaging treatment courses in total.

Each standard massaging treatment course takes about 15 minutes and includes two round travels of the massaging unit 5 caused by the drive unit 6 during which each of predetermined effective spot pairs is subjected to a finger pressure-like massage three times, and optionally a finger pressure-like massage onto outside portions of user's legs by appropriate massaging mechanisms provided in the seat portion 8, footrest 11 and the like.

In contrast, each shortened massaging treatment course takes about five minutes and includes a single round travel of the massaging unit 5 caused by the drive unit 6 during which each of predetermined effective spot pairs is subjected to a finger pressure-like massage a single time, with no optional massage onto legs. However, the contents of any shortened course are basically the same as those of a corresponding standard course.

The massaging treatment courses Nos. 1 to 6 are summarized as follows.

Course No. 1 is a fatigue relieving course in which the massaging effective spot pairs "Kenchuyu", "Shin'yu" and "Kan'yu" are massaged with a normal pressure method in this order and thereafter the "Jin'yu" is massaged with a low pressure method.

Course No. 2 is a digestive system enhancing course in which the massaging effective spot pairs "Ketsuin'yu" and "Kakuyu" are massaged with the normal pressure method and then the "Kan'yu" and "Iyu" are massaged with the low pressure method.

Course No. 3 is a bowel action enhancing course in which the massaging effective spot pair "Sanshoyu" is massaged with the normal pressure method and then the "Daichoyu" and "Shochoyu" are massaged with the low pressure method.

Course No. 4 is a liver trouble remedying course in which the massaging effective spot pairs "Ketsuin'yu" and "Kakuyu" are massaged with the normal pressure method and then the "Kan'yu" and "Sanshoyu" are massaged with the low pressure method.

Course No. 5 is a lumbago remedying course in which the massaging effective spot pair "Hiyu" is massaged with the normal pressure method and then the "Jin'yu", "Daichoyu" and "Shochoyu" are massaged with the low pressure method.

Course No. 6 is a neuralgia mitigating course in which sciatic neuralgia, for example, is mitigated by massaging the massaging effective spot pair "Daichoyu" with the normal pressure method and then the "Shochoyu" with the low pressure method, followed by providing a pressure onto legs. Course No. 6 may be programmed to mitigate intercostal neuralgia by massaging the massaging effective spot pair "Shiniyu" with the low pressure method and then the "Kakuyu" with the normal pressure method, followed by providing a pressure onto legs.

In the display surface 44 are provided a course indicator 45 for indicating the fact that the automated massaging treatment course is being selected and which of the courses Nos. 1 to 6 is selected, a position indicator 46 for indicating the current position of the upper or lower pair of massaging elements 4 by lighting a corresponding point, a time indicator for indicating remaining operation time, a massaging power indicator 48 for indicating the strength of massaging power, and like indicators. The position indicator 46 may use voice, sound (buzz), light or the like to indicate the current massaging position.

When the cover 41 is opened, the course indicator 45 is put out and instead the sign of "Free Manual Actuation Course" is turned on, while the course selecting section 42 becomes substantially inactive. The portion shaded by the cover 41 and corresponding to the course selecting section 42 is provided with a pushbutton 49 for upward inching and a pushbutton 50 for downward inching. These pushbuttons 49 and 50 are adapted to cause the drive unit 6 to operate for only a time period for which one of the pushbuttons 49 and 50 is depressed, thereby inching the acting elements 4 a desired distance.

The controller 40 further has a power ON/OFF section 52 located above the cover 41, a stature range selecting section 53 adjacent the power ON/OFF section 52, a massaging power selecting section 57 adjacent the lower edge of the controller 40, and a reclining adjusting section 58 adjacent the massaging power selecting section 57 for adjusting the inclination of the backrest portion 3. The stature range selecting section 53 has a stature range selecting pushbutton 54 and a plurality of indicator LEDs 55 for indicating a stature range selected through the stature range selecting pushbutton 54 by lighting.

In this embodiment there are three stature ranges for selection, a first one of which ranges 165 cm or less (substantially corresponding to the stature ranges A, B and C shown in Table 1), a second one of which ranges between 165 cm and 175 cm (substantially corresponding to the stature ranges D and E shown in Table 1), and the third one of which ranges between 175 cm and 190 cm (substantially corresponding to the stature range F in Table 1). These three stature ranges can substantially accommodate differences between individuals in effective spot positions. As required, it is possible to inch or slightly reciprocate the acting elements 4 so as to stimulate any intended effective spot pair assuredly. The indicator LEDs 55 correspond to these stature ranges and, hence, when one of the stature ranges is selected through the stature range selecting pushbutton 54, the corresponding indicator LED 55 is turned on.

To be described with reference to FIGS. 6 to 8 is the procedure of starting up a desired one of the automated massaging treatment courses.

The controller 40 is adapted to indicate the inputting order by sequential lighting for any user (even if not familiar with the handling of the controller 40) to be capable of handling the controller 40 with ease. Thus, when the power is turned ON, the controller 40 prompts the user to select one of the stature ranges covering his or her stature (Step 101).

The user thus prompted selects his or her stature range by depressing required times the stature range selecting pushbutton 54 in the stature range selecting section 53 (Steps 102 to 104).

In response thereto items of the specified position data corresponding to the selected stature range are read out (Steps 105, 108 and 107).

In this embodiment, if the user has not depressed the stature range selecting pushbutton 54 due to, for example, his or her unfamiliarity with the handling of the controller 40, the stature range between 165 to 175 cm is automatically selected and items of the specified position data corresponding to that stature range are read out.

Subsequently, the controller 40 prompts the user to select a desired level of massaging power (Steps 109 to 115). If this selection is not made, a medium massage power level is automatically selected.

In turn, the controller 40 prompts the user to select a desired massaging treatment course (Step 116).

To select a shortened massaging treatment course, the shortening mode key is first depressed and then any desired one of the numbered keys Nos. 1–6 is depressed (Steps 118–124). To select a standard massaging treatment course, on the other hand, any desired one of the numbered keys Nos. 1–6 is depressed without depressing the shortening mode key (Steps 131–136).

Once a desired course is selected, the corresponding program is read and executed. The procedure of each course according to a selected program is described above and hence is not described here.

Figure 10:
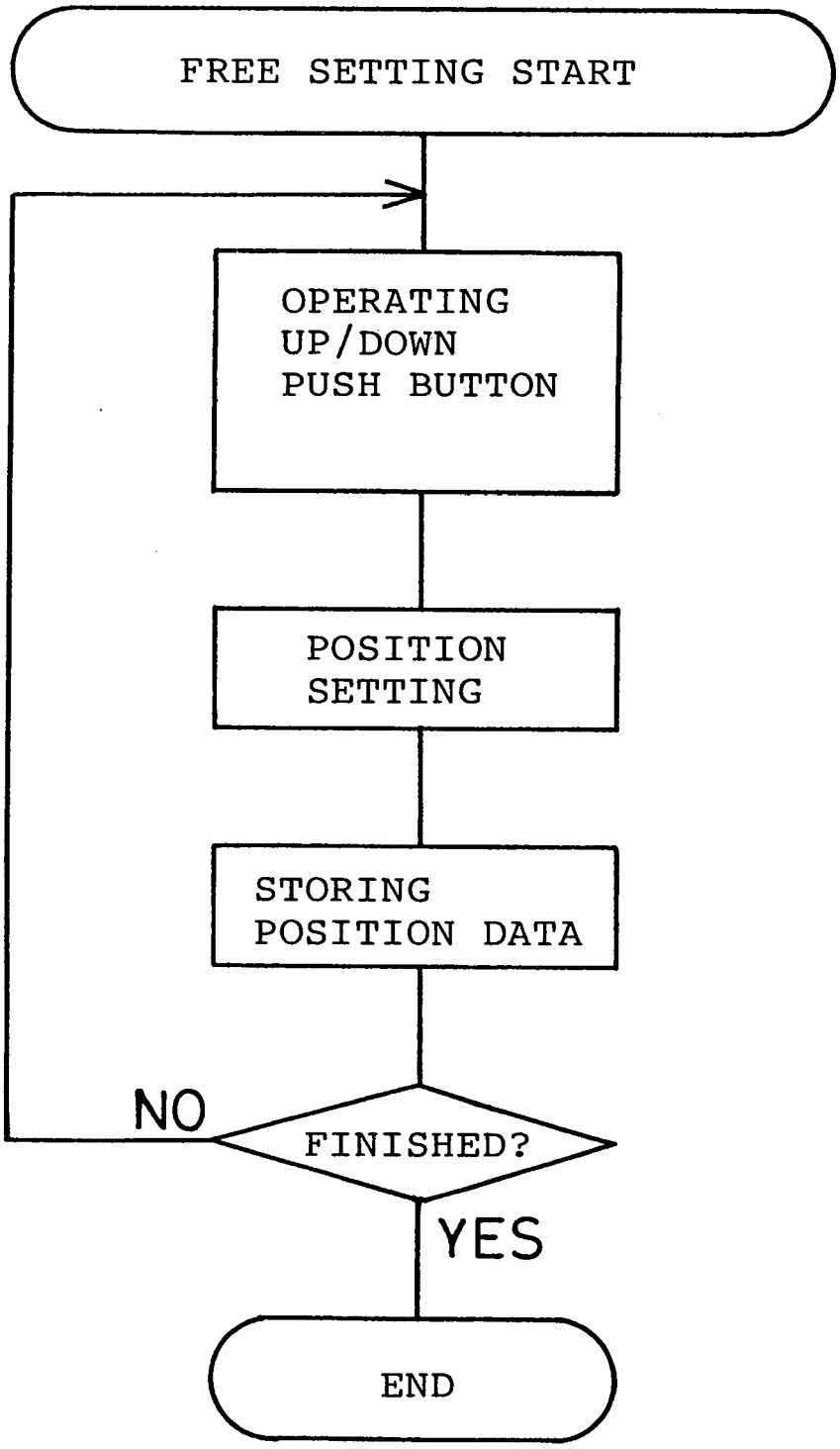
FIG. 10 is a flow chart of the procedure of freely setting personal effective spot positions of user's own.

FIG. 10 is a flow chart of another embodiment which allows entry of user's personal effective spot position data at any time instead of prestoring mean position data of predetermined effective spots.

With this embodiment, first, the user sitting in the massaging apparatus depresses a free setting pushbutton 59 provided on the controller 40. Subsequently the user depresses a raising pushbutton 49 or a lowering pushbutton 50 to move the acting elements to any desired effective spot position. If the user wishes this effective spot position to be massaged at any massaging treatment, the free setting pushbutton 59 is depressed again. Thus, this effective spot position is stored as a specified position in the storage part. Other desired effective spot positions can be stored in the same manner. Thus, the free setting pushbutton 59 and the like constitute a data inputting part of the present invention.

In operation, the execution part reads data of the entered specified positions and moves the massaging unit 5 to each specified position. Massaging such user's personal effective spot positions results in more accurate, proper and effective massage.

The entry and storage of user's personal effective spot data may be effected otherwise, for example, by entering numeric data of such personal effective spot positions.

While the presently preferred embodiments of the present invention have been described in detail, as will be apparent for those skilled in the art, various changes and modifications can be made in embodiments within the scope of the present invention. For example, it is possible to appropriately modify or change the specific structures of the massaging unit 5 and drive unit 6 and the shape and the number of acting elements. More specifically, the massaging unit 5 may employ a mechanical drive instead of the air cell drive. Further, the present invention is applicable to any chair-type massaging apparatus as well as to any massaging apparatus to be mounted on the backrest portion of a chair or to be mounted on a bed. Furthermore, the massaging apparatus of the present invention may be provided with a function of inching the massaging unit so as to optimize any massaging effective spot position after the automatic positioning of the massaging unit is completed.

What is claimed is:

1. A method of controlling an operation of a massaging apparatus including a massaging unit movable along the height of a user on the back side of the user, a drive unit for moving the massaging unit along the height of the user, and a control unit for controlling the position of the drive unit, the method comprising the steps:

storing position data of a plurality of predetermined sets of massaging spots defined for a plurality of stature ranges as specified position data;

inputting a stature range;

reading a data item out of the stored specified position data based on the input stature range; and positioning the massaging unit based on the data item thus read out;

wherein each predetermined set of massaging spots corresponds to Meridian Points for a respective stature range.

2. A method as set forth in claim 1, wherein:

said storing step comprises prestoring mean position data of each of the massaging spots for each of the plurality of stature ranges; and said positioning step comprises positioning the massaging unit based on a data item of the specified position data which corresponds to one of the stature ranges selected by the user.

3. A method as set forth in claim 2, further comprising the steps of:

inputting position data of massaging spots of the user; and storing the position data thus inputted as the specified position data.

4. A method as set forth in claim 1, further comprising the steps of:

inputting position data of massaging spots of the user; and, storing the position data thus inputted as the specified position data.

5. A method as set forth in claim 1, further comprising the step of:

causing the massaging unit to perform massaging while reciprocating along the height of the user within a predetermined range from a location corresponding to the data item of the specified position data at which the massaging unit is positioned.

6. A massaging apparatus, comprising:

a massaging unit moveable along the height of a back side of a user;

a drive unit configured to move said massaging unit along the height of the user; and a control unit configured to receive selected stature range input and to control said drive unit in order to position said massaging unit, comprising, a storage device configured to store specified position data of plurality of predetermined sets of massaging spots defined for a plurality of stature ranges, and an execution device configured to read a stored position data item corresponding to the selected stature range and to position said massaging unit based on the position data items thus read out;

wherein each predetermined set of massaging spots corresponds to Meridian Points for a respective stature range.

7. A massaging apparatus as set forth in claim 6, wherein the storage device is further configured to prestore as the specified position data mean position data of each of the massaging spots for the plurality of stature ranges.

8. A massaging apparatus as set forth in claim 7, wherein the control unit further comprises a data inputting device configured to allow position data of massaging spots of the user to be entered and stored in the storage device.

9. A massaging apparatus as set forth in claim 6, wherein the control unit is further configured to control the massaging unit to reciprocate along the height of the user within a predetermined range from a position corresponding to the data item after the massaging unit is moved to the position.

10. A massaging apparatus as set forth in claim 6, wherein the control unit further comprises a position indicating device configured to indicate a current position of the massaging unit.

11. A massaging apparatus as set forth in claim 6, wherein the control unit further comprises a data inputting device configured to allow position data for massaging spots of the user to be entered and stored in the storage device.

12. A massaging apparatus as set forth in claim 6, wherein the control unit further comprises a course selecting device configured to select a data item of the specific position data to be read out.

13. A massaging apparatus as set forth in claim 6, further comprising:

a seat portion and a backrest portion, wherein the massaging unit is disposed in the backrest portion and comprises an acting element configured to perform a massaging operation, and the control unit is configured to position the massaging unit so as to locate the acting element at a position coinciding with any one of the massaging spots.

14. A massaging apparatus as set forth in claim 13, wherein the massaging unit further comprises two driving devices configured to cause the acting element to swing in two directions along the height and the breadth of the user, wherein each of the driving devices comprises an expansible and contractible air cell.

15. A massaging apparatus, comprising:

a massaging unit moveable along the height of a back side of a user;

a drive unit configured to move said massaging unit along the height of the user; and a control unit configured to receive selected stature range input and to control said drive unit in order to position said massaging unit, comprising, a storage device configured to store specified position data of a plurality of predetermined sets of massaging spots defined for a plurality of stature ranges, a course selecting section configured to select a stored position data item of the specified position data, and an execution device configured to read the position data item corresponding to the selected stature range and to position said massaging unit based on selected position data items;

wherein each predetermined set of massaging spots corresponds to Meridian Points for a respective stature range.

* * * * *